United States Patent [19]

Indra

[11] 4,023,916

[45] May 17, 1977

[54] CYLINDER-CYLINDER HEAD MOUNTING ARRANGEMENT FOR DIESEL-TYPE FUEL INJECTION PUMPS

[75] Inventor: Jaromir Indra, Brno, Czechoslovakia

[73] Assignee: Vysoke uceni technicke, Brno, Czechoslovakia

[22] Filed: Mar. 29, 1976

[21] Appl. No.: 671,119

[30] Foreign Application Priority Data

Mar. 27, 1975 Czechoslovakia ..... 2093/75

[52] U.S. Cl. ..... 417/570; 417/499; 417/501

[51] Int. Cl.² ..... F04B 39/10; F04B 7/04

[58] Field of Search ..... 417/454, 499, 494, 500, 417/501, 570; 123/139 AE; 92/129, 171

[56] References Cited

UNITED STATES PATENTS

| | | | |
|---|---|---|---|
| 2,410,947 | 11/1946 | Johnson | 417/494 X |
| 2,545,664 | 3/1951 | Johnson | 417/499 X |
| 2,713,310 | 7/1955 | Muraszew | 417/501 |
| 3,759,637 | 9/1973 | Yuaille | 417/499 |

FOREIGN PATENTS OR APPLICATIONS

| | | | |
|---|---|---|---|
| 1,308,602 | 10/1962 | France | 417/494 |

*Primary Examiner*—Carlton R. Croyle
*Assistant Examiner*—Leonard Smith

[57] ABSTRACT

An improved assembly of the working cylinder and cylinder head in a casing of a diesel-type fuel injection pump is described. A lower portion of the cylinder head, which houses a discharge valve, is inserted into the upper portion of the cylinder. A piston reciprocable within the lower portion of the cylinder carries a flange on its lower end for supporting a spring, whose upper end bears, via an intermediate member, on the cylinder to urge the cylinder-cylinder head sub-assembly upward in the casing until a flange disposed intermediate the ends of the cylinder head abuts an upper, centrally apertured end plate of the casing. In the assembled position, an upper threaded end of the cylinder head extends outwardly from the aperture in the end plate to receive a conventional pressure fitting. Suitable facilities are provided for inhibiting rotation of the cylinder-cylinder head sub-assembly in the casing.

7 Claims, 3 Drawing Figures

CYLINDER-CYLINDER HEAD MOUNTING ARRANGEMENT FOR DIESEL-TYPE FUEL INJECTION PUMPS

BACKGROUND OF THE INVENTION

The invention relates to diesel-type fuel injection pump assemblies, and more particularly to cylinder-cylinder head mounting arrangements in such assemblies.

In known assemblies of this type, the working cylinder of the injector is mounted coaxially within a pump casing, and is associated at its upper end with a hollow cylinder head that carries a pressure or discharge valve. Conventionally, the cylinder head extends into the casing from above, and is provided with a flange which is bolted to the exterior surface of an upper end plate of the casing.

Such assemblies have the disadvantage, particularly in extremely high-pressure pump applications, that the bolts mounting the cylinder head flange to the casing have to withstand the correspondingly high pressures developed in the working space of the cylinder between the upper end of the piston and the bottom of the cylinder head. Consequently, the assembly is subject to early failure unless the related components are of expensive and rugged construction.

SUMMARY OF THE INVENTION

An improved cylinder-cylinder head mounting assembly that avoids these disadvantages is provided by the present invention. In an illustrative embodiment, the lower, discharge valve-carrying portion of the cylinder head is received tightly within the upper portion of the cylinder. The resulting cylinder-cylinder head sub-assembly is positioned coaxially within the hollow pump casing, with a threaded upper end of the cylinder head extending through the central aperture in the upper end plate of the casing. The sub-assembly is urged upwardly within the casing so that an intermediate flange on the cylinder head abuts the lower surface of the upper end plate of the casing. For this purpose, an additional flange is carried on the lower end of the piston, and a spring extends from the upper surface of such additional flange to a lower surface of a cylindrical bearing element whose upper end abuts the cylinder.

With such arrangement, the cylinder-cylinder head sub-assembly is securely positioned within the casing without the necessity of externally bolting the cylinder head to the end plate of the casing, with its attendant disadvantages. To further secure the sub-assembly within the casing from rotation, the bearing element is provided with a recess on its outer periphery, such recess receiving a pin which extends through an aligned portion of the outer wall of the casing to define a key.

In order to prevent rotation of the cylinder head when the threaded upper end thereof is mated with a conventional pressure or discharge conduit, an auxiliary flange may be positioned around such upper end and bolted to the top surface of the casing end plate, such flange exhibiting an inward projection receivable in a longitudinal groove on the cylinder head periphery.

To further secure the cylinder to the cylinder head, a feature of the invention contemplates the provision of a pin extending axially from the top surface of the cylinder to be received in a recess in the adjacent lower surface of the cylinder head flange.

In another feature of the invention, the fluid storage capacity of a conventional annular recess formed in the inner periphery of the casing intermediate its ends communicates with a pair of diametrically opposed radial chambers defined between corresponding extensions of the casing wall. The added storage volume provided by the hollow chambers has been found to diminish harmful pulsations of the fluid within the annular reservoir when such fluid is withdrawn into the interior of the working space of the cylinder during the pump suction stroke.

BRIEF DESCRIPTION OF THE DRAWING

The invention is further set forth in the following detailed description taken in conjunction with the appended drawing, in which.

DETAILED DESCRIPTION

Figure 1:
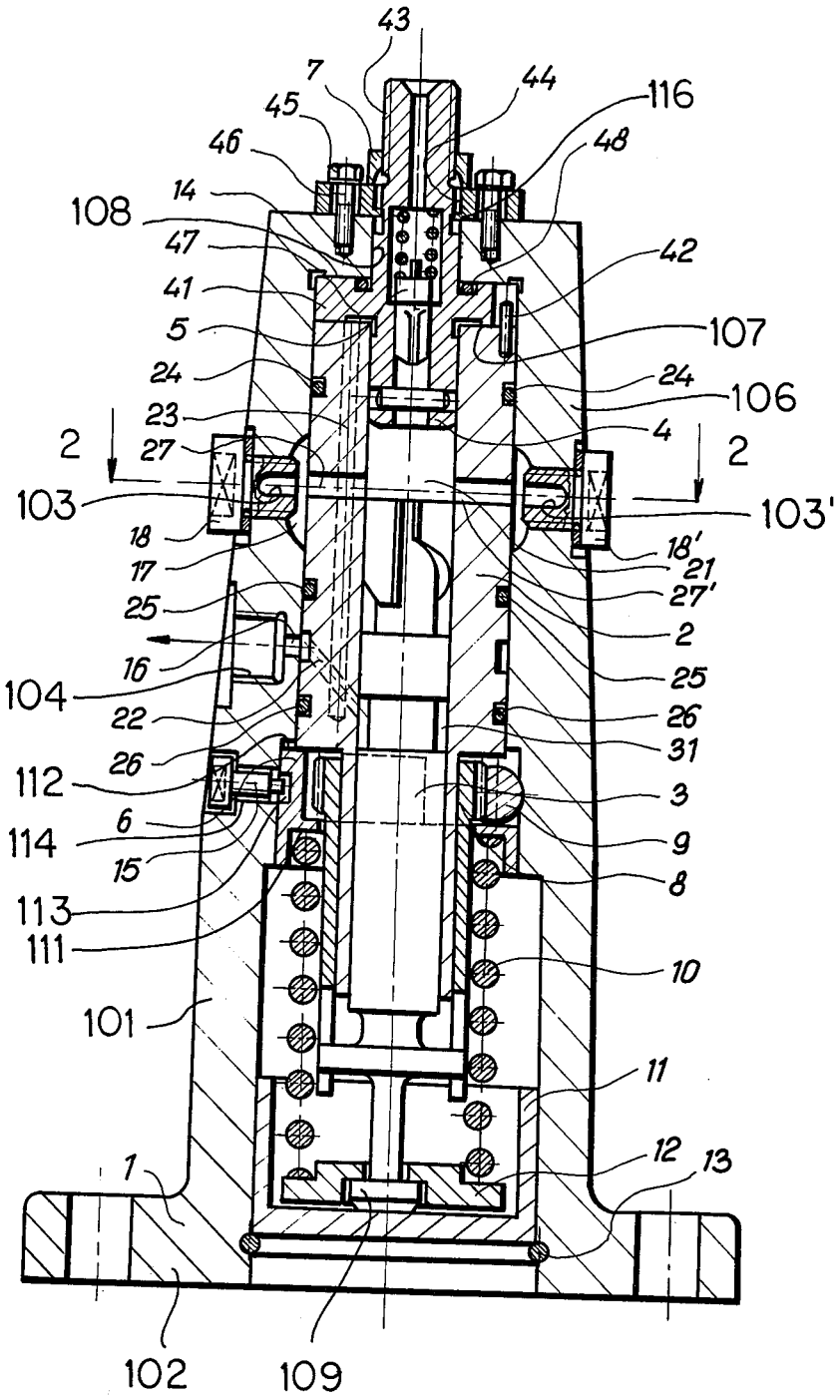
FIG. 1 is a longitudinal view, in section, of a diesel-type injection pump having a cylinder and cylinder head mounted in the pump casing in accordance with the invention.

Referring now to the drawing, a diesel-type fuel injection pump includes an elongated, vertically disposed pump casing 1 of hollow cylindrical shape, the casing having a side wall 101, a bottom flange 102, and an upper, centrally apertured end plate 14 integral with the wall 101. Supported coaxially within the interior of the casing 1 is a pump working cylinder 2. A piston 3 is mounted for reciprocation within the lower portion of the cylinder 2. A working space 21 is defined in the cylinder 2 between the top of the piston 3 and a bottom surface of a cylinder head 4, which contains a conventional discharge valve 5 and which is assembled to the casing 1 and to the cylinder 2 in the manner described below.

A pair of radial channels 27, 27' are disposed in the wall of the cylinder 2 in alignment with a fuel storage reservoir 17 in the casing wall 101. The reservoir 17, which is defined by an annular recess in the inner surface of the wall 101, is effective to supply pulses of fuel into the working space 21 through the channels 27, 27' when the piston 3 is moved downwardly through the suction stroke of the pump. The outer surface of the reservoir 17 is closed by a pair of diametrically opposed plugs 18, 18' the inner surfaces of which have axial recesses 103, 103' as shown.

A portion of the piston 3 is undercut to provide an annular recess 31 which, in the illustrated position of the piston, is in communication with an oblique passage 22 which extends through the cylinder wall and opens into a radial passage 16 in the casing wall 101. The passage 16 in turn communicates with a threaded outlet fitting 104. With this arrangement, fuel introduced into the working space 21 which leaks past the piston-cylinder interface and collects in the annular groove 31 may be withdrawn from the pump 1 via the passages 22, 16 and 104 by means of a suitable supply pump (not shown) whose suction port may be coupled to the threaded outlet port 104.

A pair of annular gaskets 24, 25 are carried on the outer surface of the cylinder 2 on axially opposite sides of the reservoir 17 for sealing the associated interfaces of the cylinder and casing. In addition, an annular gasket 26 is carried on the outer surface of the cylinder 2 below the outlet port 104 for similar interface sealing purposes.

The upper end of the cylinder 2 is adapted to tightly receive a smooth lower portion 106 of the cylinder head 4, with a lower surface of an intermediate flange 41 of the head 4 abutting the top surface of the cylinder 2 as shown. An oil-collection recess 47 is disposed in the lower surface of the flange 41, such recess forming a radial extension of an axial groove 107 disposed in the upper portion of the smooth end 106. The recess 47 communicates with an upper end of a passage 23 which extends axially through the wall of the cylinder 2, with the lower end of the passage 23 communicating with the oblique passage 22 in the cylinder wall. With this arrangement, any fuel from the working space 21 that leaks past the interface between the cylinder end 106 and the surrounding wall of the cylinder 2 is collected in the recess 47, and from there may be sucked out of the pump assembly via the axial channel 23, the oblique passage 22, the radial passage 16 and the threaded outlet port 104.

The cylinder head 4 is provided, above the intermediate flange 41, with a threaded upper portion 43 which is extendable through a central aperture 108 in the upper end wall 14 of the casing. The flange 41 itself is disposed within the casing as shown. An upper surface of the flange 41 is supported in abutting relation with the lower surface of the end wall 14 with an upward force supplied by means of a spring assembly 10, which acts through a cylindrical bearing element 6 and the wall of the cylinder 2.

For this purpose, a lower end of the spring 10 is supported on an upper surface of a flange 12, which is carried by a lower abutment 109 on the piston 3. The upper end of the spring 10 bears on a recessed lower surface 111 of the bearing element 6, such element having an upper surface 112 in contact with the cylinder 2 as shown.

Figure 3:
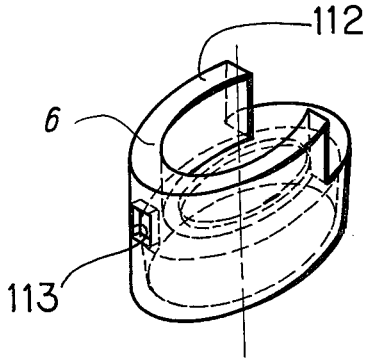
FIG. 3 is a perspective view of a cylindrical bearing element suitable for use in the arrangement of FIG. 1.

As shown best in FIG. 3, a portion of the periphery of the bearing element 6 is cut away to permit insertion of a threaded control rod 9, which cooperates with a control sleeve 8 having a complementary thread.

In order to prevent rotational movement of the bearing element 6, a keyway groove 113 is cut in its outer periphery to receive a pin or bolt 15, which extends through a radial bore 114 in the casing wall 101.

A pin 42 extends axially from the upper surface of the cylinder 2 for reception in a mating recess in the lower surface of the cylinder head flange 41. Such pin 42 is effective to further secure the cylinder-cylinder head sub-assembly against relative motion.

The upwardly extending, threaded end portion 43 of the cylinder head 4 is adapted in a conventional manner to receive a pressure or discharge conduit (not shown). In order to prevent rotation of the cylinder head 4 during the coupling of the pressure conduit thereto, the end portion 43 is provided with grooves 44, 44 extending axially below the thread thereon, such grooves 44 receiving corresponding inward projections 116 of an annular flange 45, which surrounds the grooves 44 and which is affixed to the top surface of the casing end wall 14 by means of bolts 46, 46.

If desired, an additional annular gasket 48 may be carried on a top surface of the intermediate flange 41 of the cylinder head 4 for sealing engagement with the lower surface of the casing end wall 14 as shown.

Advantageously, the cylinder-cylinder head sub-assembly upwardly urged in the casing 1 by the spring 10 may be secured within the interior of the casing by means of a closure member 11, which in turn is secured in position by means of a lock washer 13.

Figure 2:
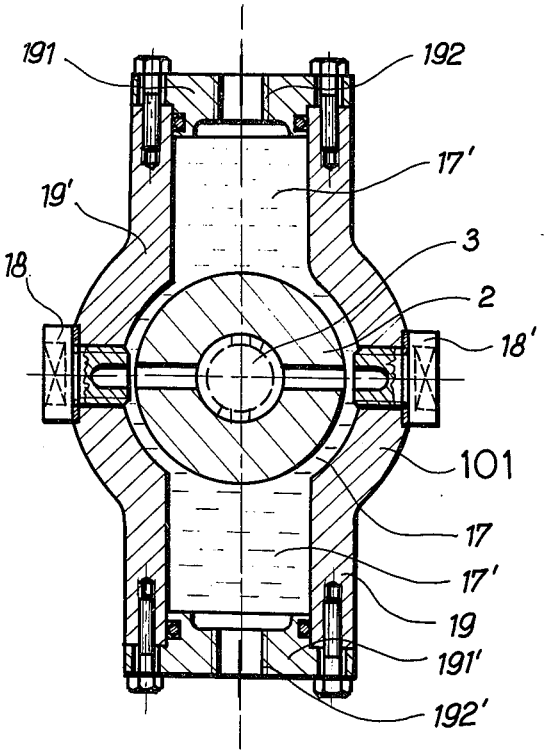
FIG. 2 is a sectional view taken along line 2—2 of FIG. 1.

Because of its relatively small fluid storage volume, the periodic discharge of fuel therefrom through the radial passages 27, 27′ and into the working space 21 of the cylinder 2 is accompanied by impact-type pulsations, which results in undesirable stresses in the not-illustrated auxiliary portions of the diesel fuel system. In further accordance with the invention, such impact-like pressure pulses are minimized by effectively increasing the storage capacity of the reservoir 17 with the additional facilities shown in FIG. 2. In particular, the portion of the casing wall 101 surrounding the reservoir 17 is provided with a pair of diametrically opposed radial extensions 19, 19′ which are closed at their respective outer ends by apertured end plates 191, 191′. The projections 19 and 19′, as thus closed, define therein a pair of hollow chambers 17′, 17′ which communicate with the reservoir 17 as shown. The end plates 191, 191′ are provided with central apertures 192, 192′ to accommodate fuel inlet and outlet fittings (not shown).

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In an injection pump assembly, an elongated, vertically disposed hollow casing having an upper, centrally apertured end plate, a working cylinder disposed coaxially within the casing, a hollow cylinder head having a lower end, an outwardly projecting first flange intermediate its ends, and a threaded upper end extendable through the central aperture of the end plate, the lower end of the cylinder head extending tightly into the upper part of the cylinder to form a cylinder-cylinder head sub-assembly with the lower surface of the first flange abutting the upper surface of the cylinder, a piston supported for reciprocation in the lower portion of the cylinder, a second flange carried on a lower end of the piston, and means including spring means having one end supported on the second flange for urging the sub-assembly upwardly in the casing to effect engagement of the upper surface of the first flange with the lower surface of the end plate.

2. An assembly as defined in claim 1, in which the urging means further comprises a cylindrical bearing element supported coaxially in the casing, the bearing element having an upper surface in engagement with the cylinder and a lower surface in engagement with the other end of the spring means, the outer peripheral wall of the bearing element exhibiting a recess, and in which the assembly further comprises means extendable through the casing wall in alignment with the recess in the bearing element for engaging such recess to inhibit rotational movement of the bearing element.

3. An assembly as defined in claim 1, in which the assembly further comprises a pin extending axially outward from the top surface of the cylinder, and means defining a recess in the adjacent lower surface of the first flange of the cylinder head for receiving the pin.

4. An assembly as defined in claim 1, in which the assembly further comprises an annular gasket carried by the upper surface of the first flange for sealing engagement with the lower surface of the end plate.

5. An assembly as defined in claim 1, in which a portion of the casing wall intermediate its ends exhibit an inner recess to define a main annular reservoir, such portion of the casing wall further exhibiting a pair of diametrically opposed radial extensions defining a pair of hollow chambers in communication with the main reservoir for increasing the fluid storage capacity of the main reservoir.

6. An assembly as defined in claim 1, in which the upper end of the cylinder head exhibits an axial groove on its outer periphery below the thread, and in which the assembly further comprises a third flange surrounding the groove on the upper end of the cylinder head and having a lower surface fixedly supported on the upper surface of the end plate, the third flange further exhibiting an inward projection aligned with and extending into the groove on the upper end of the cylinder head.

7. An asembly as defined in claim 6, in which the assembly further comprises a nut having a thread cooperable with the external thread on the upper end of the cylinder head and a lower surface abutting the top surface of the third flange.

* * * * *